US007661603B2

(12) United States Patent
Yoon et al.

(10) Patent No.: US 7,661,603 B2
(45) Date of Patent: Feb. 16, 2010

(54) CENTRAL CONTROL SYSTEM AND METHOD FOR CONTROLLING AIR CONDITIONERS

(75) Inventors: Sang Chul Yoon, Kyungki-do (KR); Duck Gu Jeon, Seoul (KR); Jae Sik Jung, Seoul (KR); Jae Hwan Kwon, Seoul (KR)

(73) Assignee: LG Electronics Inc., Seoul (KR)

( * ) Notice: Subject to any disclaimer, the term of this patent is extended or adjusted under 35 U.S.C. 154(b) by 487 days.

(21) Appl. No.: 10/677,305

(22) Filed: Oct. 3, 2003

(65) Prior Publication Data

US 2004/0107717 A1 Jun. 10, 2004

(30) Foreign Application Priority Data

Dec. 10, 2002 (KR) ..... 10-2002-0078330
Mar. 5, 2003 (KR) ..... 10-2003-0013685

(51) Int. Cl.
*G05D 23/00* (2006.01)

(52) U.S. Cl. ..... 236/51; 62/157; 62/231; 62/75; 700/295; 700/276

(58) Field of Classification Search ..... 62/157, 62/231, 175; 236/51; 700/295, 276
See application file for complete search history.

(56) References Cited

U.S. PATENT DOCUMENTS 5,104,037 A * 4/1992 Karg et al. ..... 236/46 R
5,761,083 A * 6/1998 Brown et al. ..... 700/296
6,178,362 B1 * 1/2001 Woolard et al. ..... 700/295
6,241,156 B1 * 6/2001 Kline et al. ..... 236/51
6,622,925 B2 * 9/2003 Carner et al. ..... 236/46 R
6,625,996 B2 * 9/2003 Nakajima et al. ..... 62/175
6,736,328 B1 * 5/2004 Takusagawa ..... 236/51
6,789,739 B2 * 9/2004 Rosen ..... 236/51

(Continued)

FOREIGN PATENT DOCUMENTS

DE 20011934 11/2000

(Continued)

OTHER PUBLICATIONS

English language Abstract of JP 2002-013778.

(Continued)

*Primary Examiner*—Frantz F Jules
*Assistant Examiner*—Azim Rahim
(74) *Attorney, Agent, or Firm*—Birch, Stewart, Kolasch & Birch, LLP

(57) ABSTRACT

A central control system and method for controlling air conditioners. The central control system performs central control operations for the air conditioners according to an operation schedule or control command inputted from a central controller coupled to the air conditioners through an internal network or a remote controller accessible to an external Internet network. When the air conditioners are simultaneously operated, control signals based on the control command are adjusted to prevent electric power consumption from abruptly increasing and hence the stability and reliability of control can be improved. The central controller includes a touch screen-based monitor. A control program included in the central controller provides a timetable corresponding to a specified period. An operator can conveniently input/edit the operation schedule through a dragging operation performed on the monitor, and confirm the inputted/edited operation schedule.

10 Claims, 7 Drawing Sheets

U.S. PATENT DOCUMENTS

| | | | | |
|---|---|---|---|---|
| 6,874,691 | B1 * | 4/2005 | Hildebrand et al. | 236/51 |
| 2001/0003906 | A1 * | 6/2001 | Roh | 62/231 |
| 2002/0014538 | A1 * | 2/2002 | Weimer et al. | 236/51 |
| 2002/0029096 | A1 | 3/2002 | Takai et al. | |
| 2002/0069652 | A1 * | 6/2002 | Roh et al. | 62/126 |
| 2002/0076939 | A1 * | 6/2002 | Li et al. | 438/767 |
| 2002/0115435 | A1 * | 8/2002 | Soh | 455/426 |
| 2002/0173929 | A1 | 11/2002 | Seigel | |
| 2003/0019944 | A1 * | 1/2003 | Nonaka et al. | 236/51 |
| 2003/0055534 | A1 * | 3/2003 | Saito et al. | 700/276 |
| 2003/0070438 | A1 * | 4/2003 | Kikuchi et al. | 62/141 |
| 2003/0140637 | A1 * | 7/2003 | Masui et al. | 62/127 |

FOREIGN PATENT DOCUMENTS

| | | | | |
|---|---|---|---|---|
| JP | 10-220843 | A | | 8/1998 |
| JP | 2001-197661 | A | | 7/2001 |
| JP | 2001-208405 | | | 8/2001 |
| JP | 2002-10532 | A | | 1/2002 |
| JP | 2002-013778 | | | 1/2002 |
| JP | 2002-183258 | A | * | 6/2002 |
| JP | 2002-369265 | A | | 12/2002 |
| KR | 1995-0003072 | | | 9/1993 |

OTHER PUBLICATIONS

English Language Abstract of JP2001-208405.
English Language Abstract of Korean 1995-0003072.
English language Abstract of JP 2002-369265 A.
English language Abstract of JP 2001-197661 A.

* cited by examiner

CENTRAL CONTROL SYSTEM AND METHOD FOR CONTROLLING AIR CONDITIONERS

BACKGROUND OF THE INVENTION

1. Field of the Invention

The present invention relates to a central control system and method for controlling air conditioners, which can perform central control operations for the air conditioners according to an operation schedule or control command inputted from a central controller coupled to the air conditioners through an internal network or a remote controller accessible to an external Internet network, and automatically adjust the operation schedule to appropriately supply electric power to the air conditioners.

2. Description of the Related Art

As the use of air conditioners has remarkably increased, a single-type air conditioner system configured by a plurality of indoor devices 10*a*, 10*b*, 10*c* and 10*d* and a plurality of outdoor devices 11*a*, 11*b*, 11*c* and lid has been installed in each room of a general home or in each office room within a building. Further, a multi-type air conditioner system configured by a single outdoor device and a plurality of indoor devices sharing the single outdoor device has been installed in buildings or on each story within the building, such that resources used for installation can be saved and the efficiency of energy usage can be improved.

In the above-described air conditioner systems, an operation of each air conditioner can be controlled in response to a control command based on a manager's manipulation of a plurality of buttons formed on the indoor device 10*a*, 10*b*, 10*c* or 10*d*, or in response to a control command inputted from a remote controller.

The control command inputted from a key input unit (not shown) for air conditioners including the plurality of buttons, or the remote controller, is sent to a microcomputer. The microcomputer is embedded in the indoor device 10*a*, 10*b*, 10*c* or 10*d* of the conventional air conditioner. The microcomputer generates a control signal for an indoor cooling/heating operation, and outputs the control signal to a corresponding outdoor device. Thus, a user's control command is primarily inputted into each indoor device 10*a*, 10*b*, 10*c* or 10*d*, and the inputted control command is processed. The outdoor device 11*a*, 11*b*, 11*c* or 11*d* appropriately circulates or distributes coolants in response to the control signal.

If an operation of the air conditioner is not proper, the manager must move to a place where the air conditioner is installed and then input a control command necessary for a repair and maintenance procedure into the air conditioner as shown in FIG. 1. Where the multiple indoor devices 10*a*, 10*b*, 10*c* and 10*d* are installed on each of stories within a large-sized building, respectively, there is a drawback in that manpower and cost for managing the air conditioners increase significantly.

With the development of a network, a plurality of air conditioners may be coupled to an IP sharer through the network. In the network, a central controller is installed to collectively control the air conditioners. The central controller can conventionally control an operating system of each air conditioner. The central controller conventionally has buttons used for inputting on/off commands for the air conditioners and lamps used for confirming on/off states of the air conditioners through a lighting on/off operation. However, there are problems in that a physical control range within which the air conditioners may be controlled is extremely limited and hence the air conditioners cannot be conveniently controlled.

In particular, where power supplies of the air conditioners requiring a significant amount of electric power are simultaneously turned on, the load of electric power is abruptly increased within the building equipped with the air conditioners and hence a power circuit breaker may not appropriately operate. In this case, all electric power within the building may be compulsorily cut off. At this time, other electric devices also cannot be used. Of course, since problems such as an operating error, data loss, etc. can be caused by an operation error of the power circuit breaker, it must be noted that the large number of air conditioners cannot be simultaneously operated.

To schedule the operations of the air conditioners, the manager must move to each of the indoor devices 10*a*, 10*b*, 10*c* and 10*d* and manipulate a key input unit to input operation time information associated with an air-conditioner start/stop time, etc.

However, the number of buttons formed on the conventional remote controller for the air conditioner is limited. Since a procedure of inputting an operation schedule is complicated, there are problems in that an operator's manual must be referred to and the increased number of manipulations is needed to input the operation schedule. Since the remote controller is not equipped with a liquid crystal display (LCD), or a size of the LCD arranged on the remote controller is small, it is difficult for time information of the operation schedule to be confirmed.

SUMMARY OF THE INVENTION

Therefore, the present invention has been made in view of the above problems, and it is an object of the present invention to provide a central control system and method for controlling air conditioners, which can control the air conditioners according to an operation schedule or control command inputted from a central controller capable of performing central control operations for the air conditioners or a remote controller coupled to the central controller through an Internet network so that a control range can be extended.

It is another object of the present invention to provide a central control system and method for controlling air conditioners, which can perform an integrated schedule management operation using a central controller in which a control program is executed so that an operation schedule of the air conditioners can be inputted/edited/confirmed.

It is yet another object of the present invention to provide a central control system and method for controlling air conditioners, which can automatically adjust an operation schedule to prevent consumption of electric power from abruptly increasing when the air conditioners are simultaneously operated, and perform a stable power management operation.

In accordance with one aspect of the present invention, the above and other objects can be accomplished by the provision of a central control system for controlling a plurality of air conditioners, comprising: the air conditioners installed indoors for performing air conditioning operations; and a central controller for receiving a control command for monitoring or controlling operating states of the air conditioners, automatically scheduling control signals corresponding to the control command to manage electric power consumption at a time of simultaneously operating the air conditioners, and outputting the scheduled control signals to the air conditioners.

In accordance with another aspect of the present invention, there is provided a method for controlling air conditioners in a central control system, comprising the steps of: (a) transmitting, to the air conditioners, an operation schedule and a control command inputted through a central controller capable of performing central control operations for the air conditioners, and simultaneously monitoring operating states of the air conditioners; (b) generating control signals so that the air conditioners can be operated in response to the operation schedule and control command inputted at the step (a); and (c) adjusting time intervals between operations of the air conditioners to manage electric power consumption.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
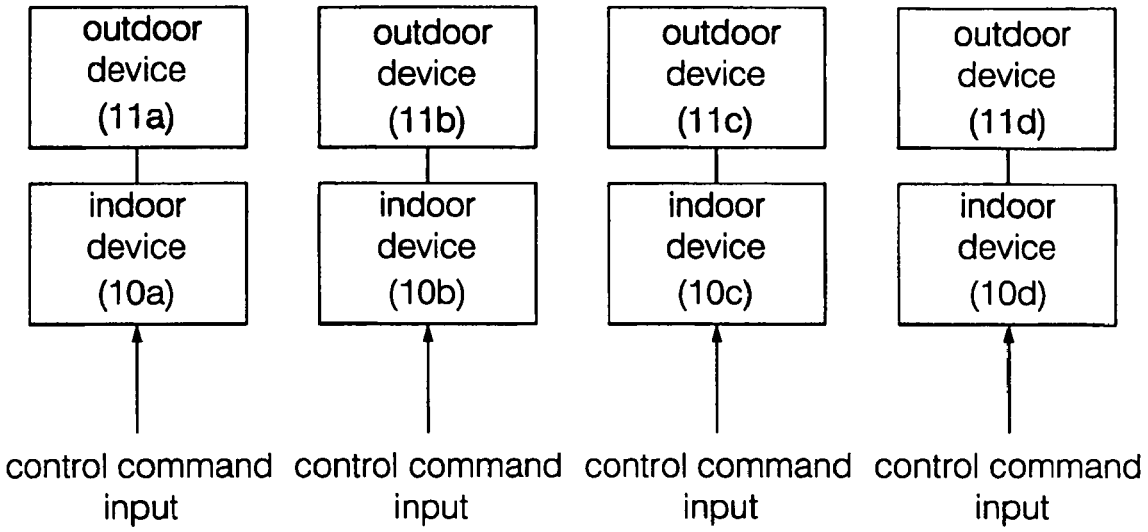
Fig. 1(Prior Art)
FIG. 1 is a view illustrating the configuration of a conventional air conditioner control system.
Figure 2:
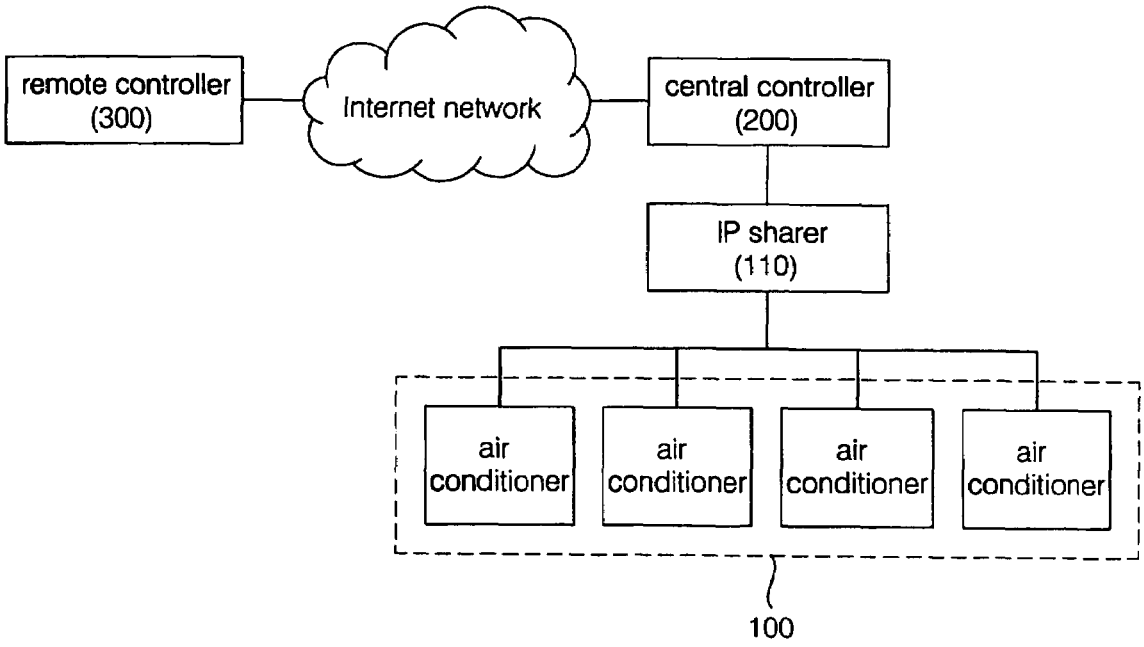
FIG. 2 is a view illustrating the configuration of a central control system for controlling air conditioners in accordance with the present invention.

First, the configuration of a central control system for controlling air conditioners will be described in detail with reference to FIG. 2.

A system of air conditioners including a plurality of indoor devices and a plurality of outdoor devices installed in each room of a general home or in each office room within a building is referred to as a single-type air conditioner system. Further, a system of air conditioners including a single outdoor device and a plurality of indoor devices sharing the single outdoor device installed in each room of a general home or in each office room within a building is referred to as a multi-type air conditioner system. Hereinafter, the air conditioners included in the above-described air conditioner systems are referred to as a plurality of air conditioners 100. Further, the air conditioners can include not only an air conditioner for performing a cooling operation, but also a heat-pump-type air conditioner for performing a cooling or heating operation and all devices capable of performing an air conditioning operation.

The plurality of air conditioners 100 are connected to an internal network. Different IP addresses are assigned to the air conditioners 100. The air conditioners 100 are discriminated from each other by the assigned IP addresses. The air conditioners 100 are connected to an IP sharer 110 which performs an integrated IP address management operation. The IP sharer 110 is connected to a central controller 200 capable of performing a central control operation for the air conditioners 100.

Since the central controller 200 is connected to an external Internet network, it can perform a relay function between the internal network within a building and the external Internet network using the IP sharer 110. Thus, a remote operator capable of manipulating the remote controller 300 accessible to the Internet network can access the central controller 200 such that a control command for controlling operations of the air conditioners 100 can be inputted into the central controller 200. The remote controller 300 includes all devices accessible to the Internet network. Here, the devices include a personal computer, notebook computer, personal digital assistant (PDA), mobile terminal, etc.

The central controller 200 executes a web page such that the remote controller 300 can be coupled to the central controller 200 through the Internet network. A control program is executed such that the air conditioners can be controlled or monitored through the web page.

The operator can remotely control the air conditioners 100 through the central controller 200 in a building. The operator can access the central controller 200 through the external Internet network and input a control/monitoring command such that a remote/central control operation for the air conditioners 100 can be performed. At this time, a user can set an air temperature, air volume, air velocity, etc. for the air conditioners, and input an operation schedule associated with an air-conditioner start/stop time according to an office-opening/closing time, etc.

Thus, the central controller 200 basically includes an input unit (not shown) for inputting a control command needed for performing control operations for the air conditioners 100; a screen output unit (not shown) for displaying information associated with operating states of the air conditioners 100 and results of the air-conditioner control operations; a data processor (not shown) for processing data according to the control command inputted through the input unit or remote controller 300 and transmitting the processed data to the air conditioners 100; and a database (DB) for storing state information of the air conditioners 100, a control command input history, a control result history, etc.

Here, the central controller 200 in accordance with the present invention can include a touch screen-based monitor (not shown) capable of performing all the functions of the input and display output units. A graphic user interface (GUI) of the control program is displayed on the monitor, and the control command can be inputted when a tool such as a touch pen or fingertip is touched on the monitor.

Figure 3:
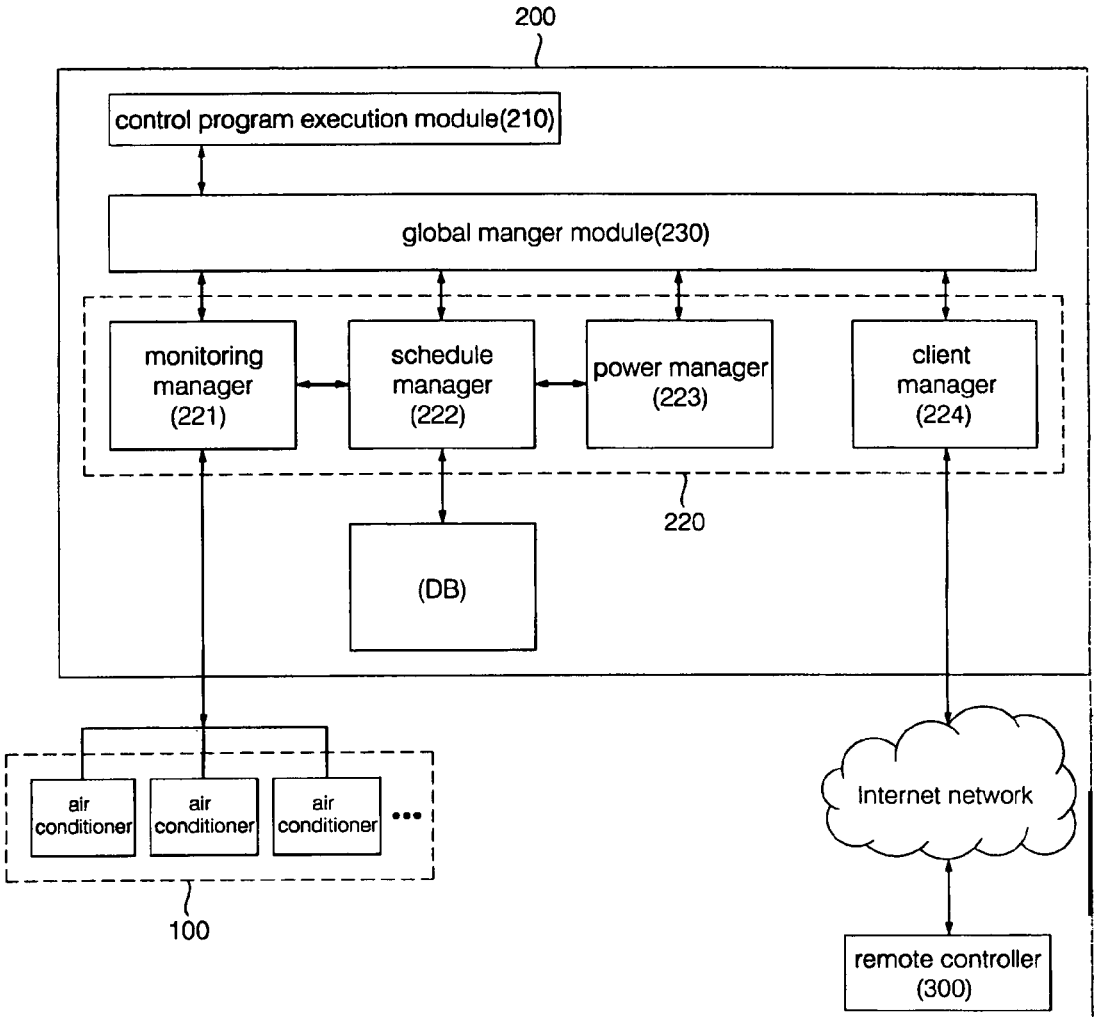
FIG. 3 is a view illustrating the internal configuration of a central controller included in the central control system in accordance with the present invention.

An internal configuration of the central controller 200 will be described in detail with reference to FIG. 3.

The central controller 200 includes a control program execution module 210 for receiving the control command for controlling the air conditioners 100 and executing the control program so that information of an operating state can be outputted in response to the control command; a manager module 220 for outputting the control command inputted through the control program to the air conditioners 100, monitoring the operating states of the controlled air conditioners and managing a time schedule of control signals to be outputted to the air conditioners 100; and a global manager module 230 for globally controlling the manager module 220.

The manager module 220 includes a monitoring manager 221, schedule manager 222, power manager 223 and client manager 224. First, the monitoring manager 221 connected to the air conditioners 100 continuously communicates data with the air conditioners 100 to monitor the operating states of the air conditioners 100. The monitoring manager 221 acts as a communication interface for sending the control command inputted through the control program to the air conditioners 100.

The schedule manager 222 generates a time schedule of the control signals on the basis of the control command or schedule data inputted through the control program. To do this, the schedule manager 222 is coupled to the database (DB) for storing the control command history inputted through the control program and storing information of the operating states of the air conditioners 100. The schedule manager 222 reads information stored in the DB.

The power manager 223 adjusts start time intervals of the air conditioners 100 so that the case where a value of an instant power consumption peak exceeds an allowable range defined by the power circuit breaker can be prevented when the air conditioners 100 are simultaneously operated.

That is, although the air conditioners 100 are simultaneously turned on at 8 a.m. according to the operation schedule inputted through the control program, the power manager 223 produces a total amount of power to be consumed by the air conditioners 100 in response to the control command, allows the air conditioners 100 to be simultaneously operated if the total consumption amount of electric power is within the allowable range, and adjusts the operation schedule so that the start times of the air conditioners 100 can be different according to delay times if the total consumption of electric power exceeds the allowable range.

The operation schedule based on a simultaneous operation command is automatically adjusted according to the power management functionality of the power manager 223. Thus, the operator manipulates the central controller 200 once, and can input the control command or operation schedule for the air conditioners 100, such that a time needed for performing a control and management operation can be reduced. Where a number of air conditioners are installed in a large-sized building or school, the efficiency and convenience of control can be further improved.

The client manager 224 executes the web page such that the control command is inputted and the operating states of the controlled air conditioners are monitored through the remote controller 300 for controlling the air conditioners 100 coupled to the central controller 200 over the Internet network.

The control program execution module 210 is linked to the client manager 224 so that the control program can be executed through the web page or by the central controller 200.

Figure 4:
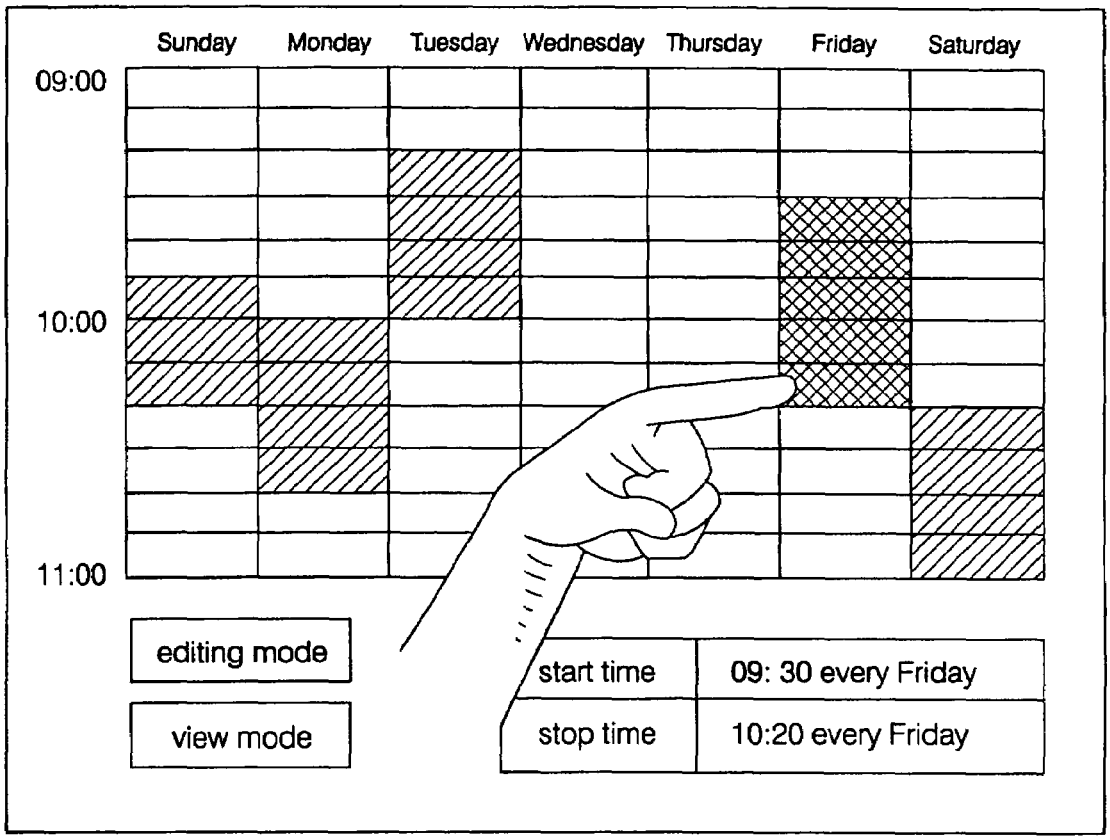
FIG. 4 is a view illustrating a monitor's display based on a control program executed by the central controller in accordance with the present invention.
Figure 5:
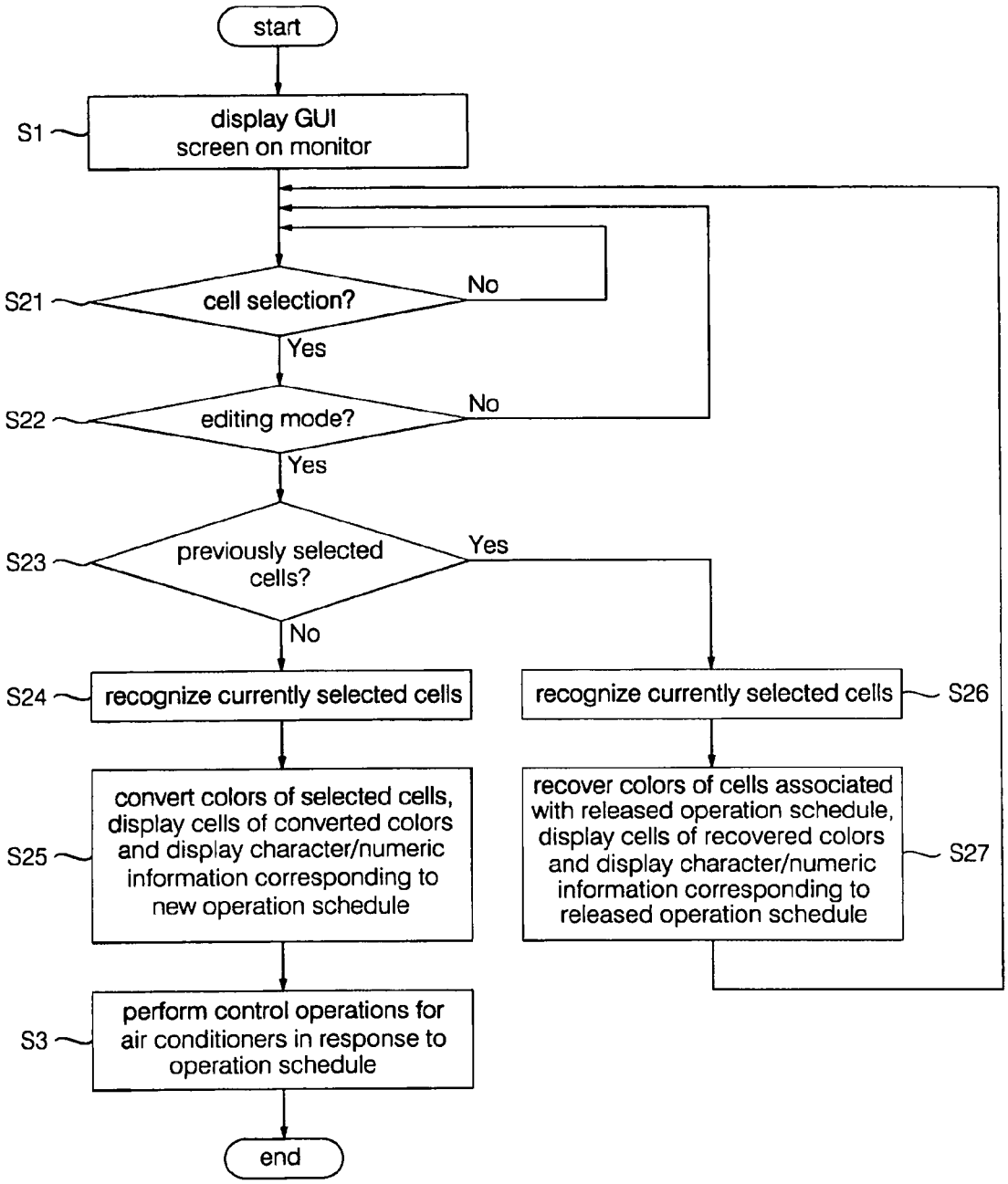
FIG. 5 is a flowchart illustrating an operation of the control program for the air conditioners in accordance with the present invention.

Here, the operation of the control program will be described with reference to FIGS. 4 and 5. FIG. 4 is a view illustrating a monitor's display based on the control program executed by the central controller in accordance with the present invention; and FIG. 5 is a flowchart illustrating the operation of the control program for the air conditioners in accordance with the present invention.

The control program is executed to display, on the monitor, a timetable needed for inputting or editing the operation schedule for the air conditioners corresponding to a specified period. Here, the timetable includes a plurality of cells. At this time, the operation schedule is set and displayed in units of day/week/month/year. In FIG. 4, the operation schedule for a week is shown.

The plurality of cells displayed on the monitor by the control program can be discriminated in units of second/minute/hour. Each unit of time can be set and changed by the operator. As shown in FIG. 4, one cell corresponds to 10 minutes. If the central controller includes the touch screen-based monitor, the operator can schedule start and stop times by directly dragging each cell on the monitor.

Where the monitor provided in the central controller is not the touch screen-based monitor, the operation schedule can be inputted using an additional input device of a keyboard or mouse, and the case where the operation schedule for the air conditioners is inputted through the remote controller also can use the additional input device.

At this time, the control program can convert colors of selected cells or cells selected on a day-by-day basis so that cells selected to input the operation schedule for the air conditioners can be discriminated from other cells not selected, and the selected cells discriminated by the colors can be displayed.

The control program provides a screen for inputting/editing the operation schedule and a screen for confirming a previously inputted schedule history to the user or operator. Further, an editing mode button and a view mode button are displayed at a lower portion of FIG. 4, and the operator can change a mode by designating any one button with a touch of his fingertip.

If the user selects an editing mode to input the operation schedule and selects cells corresponding to time information based on the operation schedule, character/numeric information corresponding to the selected cells is displayed at the lower portion of the left in FIG. 4.

In accordance with this embodiment of the present invention associated with FIG. 4, the user has dragged and selected cells corresponding to a period of a start time of 9:30 a.m., Friday, to a stop time of 10:20 a.m., Friday. The character/numeric information corresponding to the selected cells is displayed through the screen.

A method of setting the operation schedule using the control program is shown in FIG. 5.

In brief, the method includes a procedure of displaying a scheduling screen of the control program implemented by considering the GUI at step S1; a procedure of scheduling the start time and stop time by manipulating buttons and cells displayed on a GUI screen at steps S21 to S27; and a procedure of controlling the operations of the air conditioners according to the inputted operation schedule at step S3.

The procedure of selecting cells corresponding to the time information at the above step S21 to S27 will be described in detail. First, the data processor (not shown) of the central controller determines whether cells have been selected through the touch-screen based monitor or input device at step S21. If no cell is selected, the above step S21 is repeated such that the data processor can continuously determine whether the cells have been selected through the touch screen-based monitor or input device.

If it is determined that the cells have been selected, the data processor determines whether an operating mode is an editing mode at step S22. If the operating mode is not the editing mode, the above step S21 is repeated.

If the operating mode is the editing mode at the above step S22, the data processor determines whether previously selected cells exist at step S23.

If the previously selected cells exist as a result of the determination at the above step S23, the data processor recognizes a plurality of cells selected by the operator as a new operation schedule at step S24.

At step S25, the data processor converts colors of the selected cells such that the selected cells can be discriminated from other cells, and the selected cells discriminated by the colors can be displayed. At this time, the data processor displays character/numeric information corresponding to the time information of the selected cells on the screen.

If the previously selected cells exist as the result of the determination at the above step S23, the data processor releases the operation schedule of the previously selected cells at step S26.

At step S27, the data processor releases a graphic effect of the cells corresponding to the released operation schedule, and displays character/numeric information corresponding to the time information of the released operation schedule's cells on the screen so that the operator can easily confirm the released operation schedule.

Figure 6:
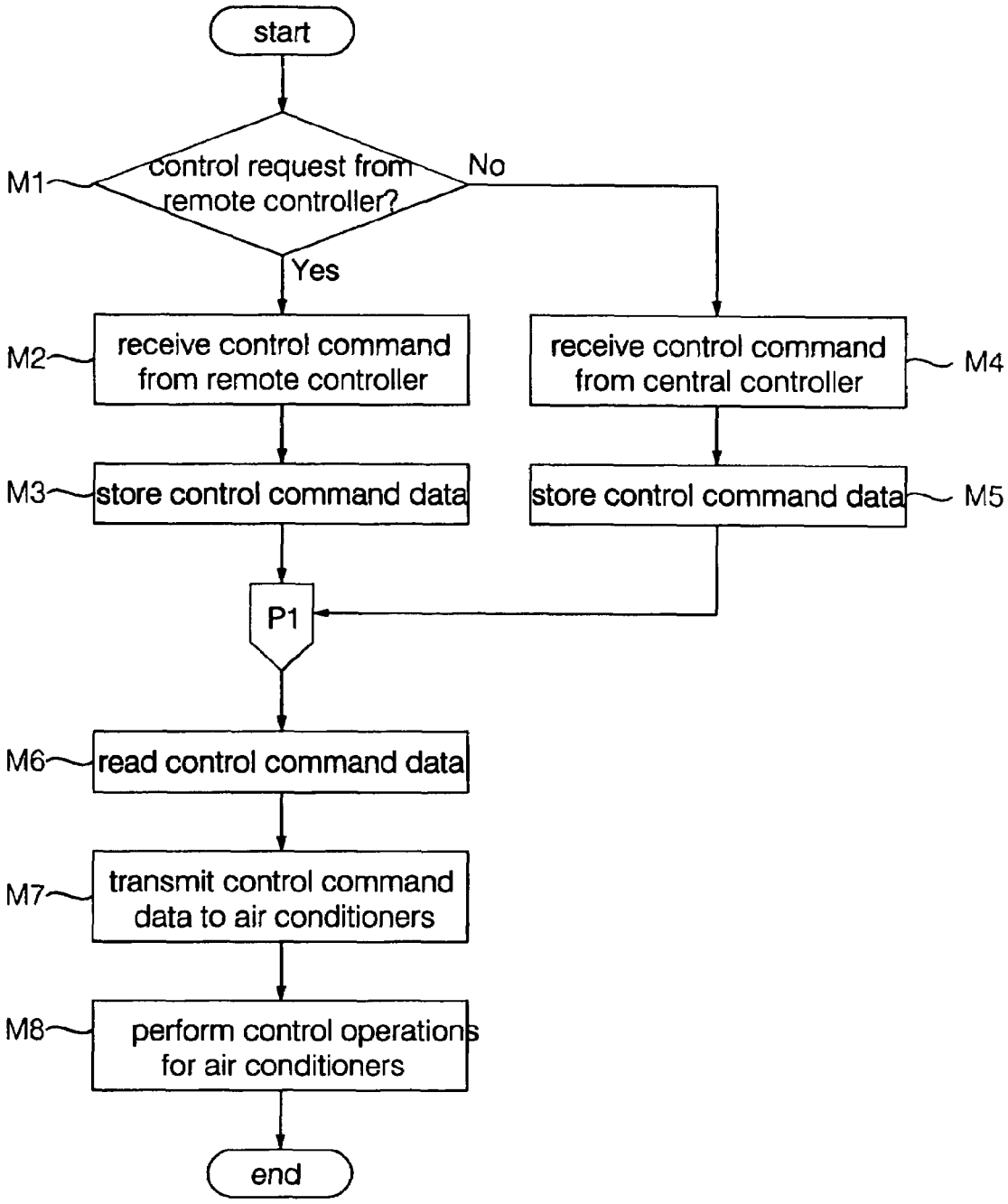
FIG. 6 is the first flowchart illustrating a method for controlling the air conditioners in the central control system in accordance with the present invention.
Figure 7:
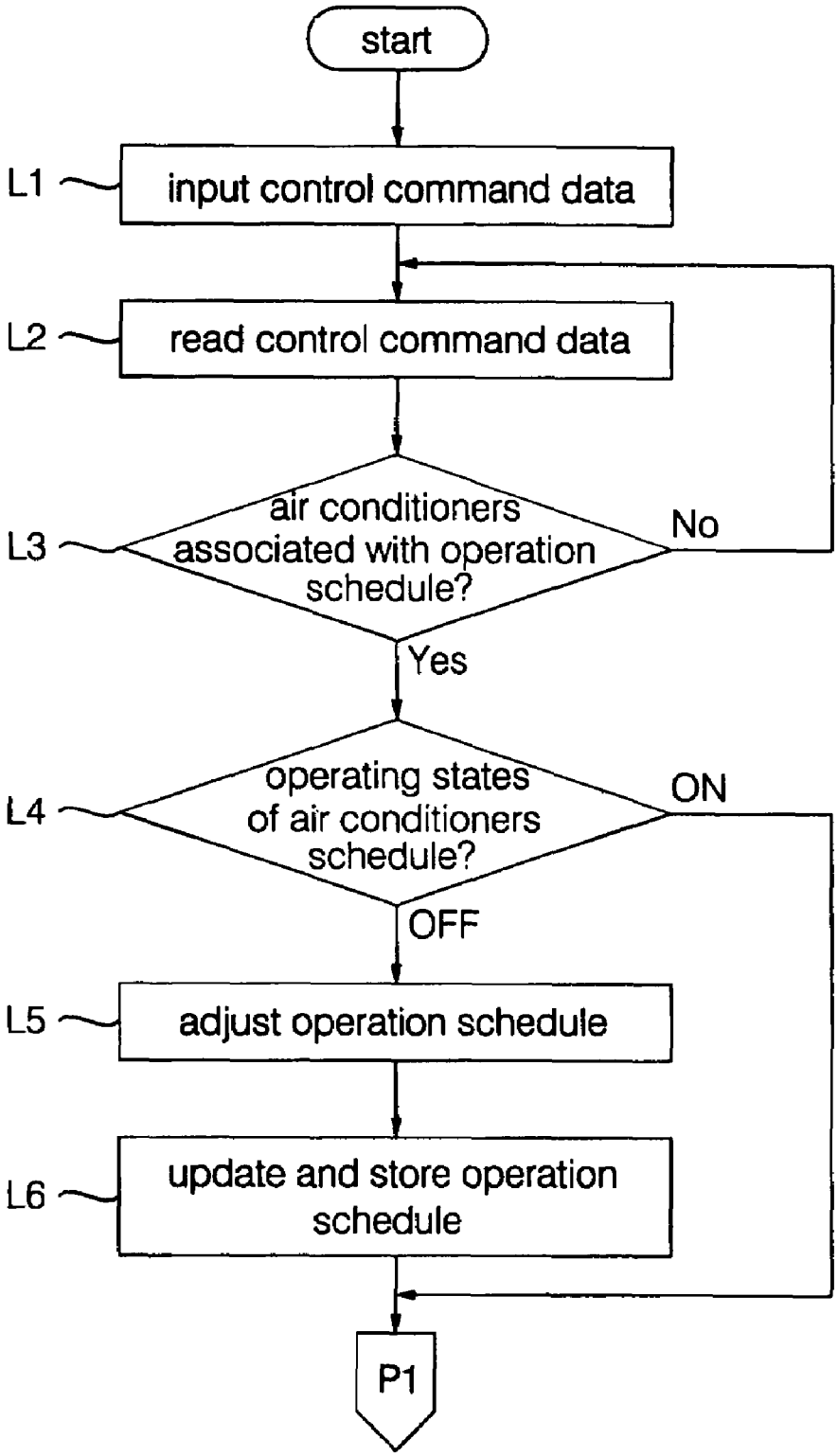
FIG. 7 is the second flowchart illustrating the method for controlling the air conditioners in the central control system in accordance with the present invention.

The method for controlling the air conditioners in the central control system in accordance with the present invention will be described. FIGS. 6 and 7 are flowcharts illustrating the method for controlling the air conditioners. FIG. 6 is a flowchart illustrating operations of the client manager and monitoring manager; and FIG. 7 is a flowchart illustrating operations of the schedule manager and power manager.

First, the client manager of the central controller senses a control request from the remote controller coupled to the central controller through the Internet network at step M1 in FIG. 6.

A control command is inputted through the control program executed on the web page at step M2, and the control command is stored in the database of the central controller at step M3. The control command is for a monitoring or function control operation. In response to the control command, the air conditioner designation, a desired temperature selection, air velocity, air direction, air-conditioner on/off, etc. can be controlled.

If the control request is not received from the remote controller, the control command is inputted from the central controller at step M4, and control command data, associated with the operation schedule, monitoring operation and function control operation, inputted by the operator is stored in the database at step M5.

The monitoring manager reads the control command data stored in the database at step M6, and transmits the read control command to the corresponding air conditioners at step M7. Control operations for the air conditioners are performed on the basis of the control command data at step M8.

The operations of the schedule manager and power manager will be described with reference to FIG. 7.

Control command data including an operation schedule of the air conditioners is inputted through the remote controller or central controller at step L1, and the inputted control command data is stored in the database.

The schedule manager reads the control command data stored in the database at step L2, and determines whether air conditioners associated with the operation schedule exist at step L3. If no air conditioner associated with the operation schedule exists, the schedule manager reads another control command data. On the other hand, if the air conditioners associated with the operation schedule exist, on/off states of the air conditioners are sensed at step L4.

If the air conditioners are turned off, the operation schedule is automatically adjusted to prevent the abrupt increase of power consumption at a time of simultaneously operating the air conditioners at step L5. That is, the power manager performs a power management operation for the air conditioners on the basis of delay times so that the air conditioners can be operated at different times. The adjusted operation schedule is updated and stored in the database at step L6.

When at least one of the air conditioners is already operating, the power manager does not perform the power management operation for the air conditioner already turned on. That is, only a control operation for the turned-on air conditioner is performed.

Then, steps below "P1" indicated in FIGS. 6 and 7 are performed. The monitoring manager reads the control command data stored in the database at step M6, and transmits the read control command data to the air conditioners to be controlled at step M7.

Control operations for the multiple air conditioners are performed on the basis of the control command data at step M8.

As described above, a central control system and method for controlling air conditioners have been described with reference to the annexed drawings. However, the present invention is not limited by the preferred embodiments and drawings. The present invention is applicable to various technical fields.

As apparent from the above description, the present invention provides a central control system and method for controlling air conditioners, which can perform central control operations for the air conditioners located in a building by manipulating a central controller coupled to the air conditioners through an internal network or a remote controller connected to the central controller through an external Internet network, thereby improving the convenience of control. The system and method automatically adjust an operation schedule to prevent electric power consumption from abruptly increasing when the air conditioners can be simultaneously operated, thereby improving the stability and reliability of control.

In accordance with the present invention, the central controller executes an air conditioner control program so that an operator can input the control command with his fingertip on a touch screen-based monitor and the operation schedule can be easily and promptly inputted.

What is claimed is:

1. A central control system for controlling air conditioners, comprising:

a plurality of air conditioners installed indoors that perform air conditioning operations; and a central controller that receives a control command to control the plurality of air conditioners, that monitors operating states of the controlled air conditioners, that automatically schedules control signals corresponding to the control command so that start times for operation of individual ones of the plurality of air conditioners can be adjusted to manage electric power consumption due to simultaneously operating the plurality of air conditioners, and that outputs the scheduled control signals to the plurality of air conditioners;

wherein the central controller estimates a total amount of instant electric power consumption of the plurality of air conditioners; and based upon whether the total amount of estimated instant electric power exceeds an allowable range, the central controller adjusts an operation schedule of each of the plurality of air conditioners enabling the start times of each of the plurality of air conditioners to differ according to delay times, the central controller comprising:

a touch screen-based monitor configured to input the control command through a screen touch operation, wherein the central controller displays a control program for controlling operations of the air conditioners, the control program being executed so that a timetable in which an operation schedule for the plurality of air conditioners corresponding to a specified period can be displayed on the monitor, and the timetable can be input and edited from the monitor, the timetable having a number of cells, the control program converting colors of cells selected to input the operation schedule for the plurality of air conditioners can be distinguished from non-selected cells, and the selected cells distinguished by the colors can be displayed, the control program being further configured to receive the operation schedule of the designated air conditioners by dragging and selecting the cells on the monitor.

2. The central control system as set forth in claim 1, wherein the air conditioners are connected to an internal network, and the air conditioners are assigned different internet protocol addresses so that the air conditioners can be distinguished from each other.

3. The central control system as set forth in claim 2, further comprising:

an internet protocol sharer connected to the central controller that performs an integrated management operation for the internet protocol addresses assigned to the air conditioners.

4. The central control system as set forth in claim 1, the central controller comprising:

a control program execution module that receives the control command and executes a control program so that information of the operating states can be output in response to the control command;

a manager module that transmits the control command input through the control program to the plurality of air conditioners, that monitors operating states of the controlled air conditioners, and that manages a time schedule of the control signals to be output to the plurality of air conditioners so that time intervals between operation of the plurality of air conditioners can be adjusted; and a global manager module that globally controls the manager module.

5. The central control system as set forth in claim 4, the manager module comprising:

a monitoring manager that communicates data with the plurality of air conditioners and that monitors the operating states of the controlled air conditioners;

a schedule manager that generates a time schedule according to the control command input through the control program; and a power manager that adjusts time intervals between operations of the plurality of air conditioners.

6. The central control system as set forth in claim 5, the manager module further comprising:

a client manager that provides a web page so that the control command can be input and the operating states of the controlled air conditioners can be monitored by a remote controller coupled to the central controller through the internet network.

7. The central control system as set forth in claim 5, wherein the schedule manager is connected to a database, and reads the control command input through the control program and state data from the database.

8. A method for controlling a plurality of air conditioners in a central control system, comprising:

transmitting, to the plurality of air conditioners, an operation schedule and a control command input through a central controller capable of performing central control operations for the plurality of air conditioners, and simultaneously monitoring operating states of the plurality of air conditioners;

generating control signals so that the plurality of air conditioners can be operated in response to the operation schedule and the control command input at the transmitting; and adjusting start times for operation of each of the plurality of air conditioners to manage electric power consumption;

wherein inputting the operation schedule for the plurality of air conditioners comprises: displaying a timetable having a plurality of cells on a touch screen based monitor of the central controller;

receiving the operation schedule by dragging and selecting the cells on the monitor; displaying the selected cells on the monitor to define the operation schedule, the timetable being input-able and editable from the monitor;

displaying the selected cells with colors different from non-selected cells, and adjusting an operation schedule of each of the plurality of air conditioners to enable the start times of each of the plurality of air conditioners to differ according to a delay time, based upon whether an estimated total amount of instant electric power consumed by the plurality of air conditioners exceeds an allowable range.

9. The method as set forth in claim 8, the transmitting comprising:

sensing a control request from a remote controller for inputting control command data to the plurality of air conditioners through an internet network;

storing the control command data input by the remote controller in the database of the central controller; and transmitting the control command data stored in the database to the plurality of air conditioners and monitoring operating states of the plurality of air conditioners.

10. The method as set forth in claim 8, wherein the dragging comprises:

determining whether cells have been touched and selected;

ascertaining whether an operating mode is a schedule editing mode when the cells have been touched and selected;

releasing the operation schedule associated with previously selected cells when the operating mode is the schedule editing mode; and repeating the determining, ascertaining and releasing when no previously selected cells exist.

* * * * *